United States Patent [19]

Ostermeier et al.

[11] 4,139,800

[45] Feb. 13, 1979

[54] BISTABLE STORAGE TARGET HAVING INTERDIGITATED TARGET ELECTRODE FOR SELECTIVE ERASURE

[75] Inventors: Bruce H. Ostermeier; Duane A. Haven, both of Portland; Gordon M. Sletmoe, Tualatin, all of Oreg.

[73] Assignee: Tektronix, Inc., Beaverton, Oreg.

[21] Appl. No.: 810,349

[22] Filed: Jun. 27, 1977

[51] Int. Cl.[2] ..... H01J 29/50; H01J 31/00

[52] U.S. Cl. ..... 315/13 ST; 313/398

[58] Field of Search ..... 315/12 R, 13 ST; 313/398; 328/123

[56] References Cited

U.S. PATENT DOCUMENTS

| | | | |
|---|---|---|---|
| 3,651,362 | 3/1972 | Takita | 313/398 |
| 3,956,662 | 5/1976 | McTeague et al. | 313/398 |

*Primary Examiner*—Theodore M. Blum
*Attorney, Agent, or Firm*—Adrian J. La Rue

[57] ABSTRACT

A bistable storage target for use with a cathode ray storage tube is provided with electrode members forming an interdigitated electrode means. Electrode members connected to one bus bar are provided with collector electrode means which extend through a storage dielectric covering the electrode means for collecting secondary electrons emitted from written areas of the storage dielectric. Electrode members connected to another bus bar are isolated from the first bus bar electrode members and they are raised to a predetermined positive voltage subsequent to the flood gun means being turned off, the writing gun is turned on and the electron beam is directed to a selected area of the target thereby erasing the stored written information thereon.

15 Claims, 12 Drawing Figures

Fig-8
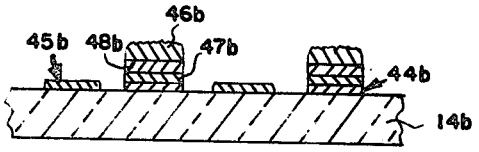
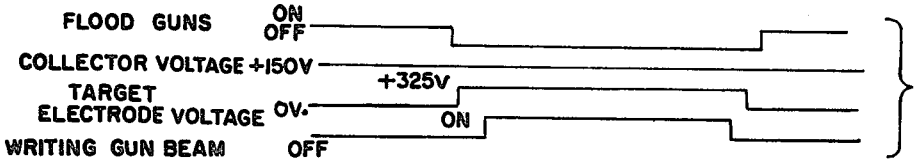
Fig-9
Fig-10
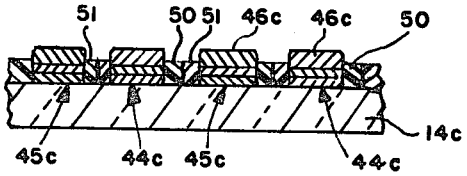
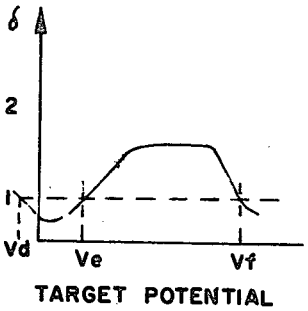
Fig-11
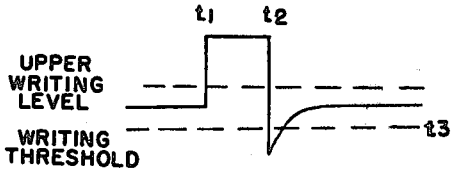
Fig-12

BISTABLE STORAGE TARGET HAVING INTERDIGITATED TARGET ELECTRODE FOR SELECTIVE ERASURE

BACKGROUND OF THE INVENTION

U.S. Pat. No. 3,594,607 to Frankland discloses a direct viewing bistable storage target of a bistable storage tube which is provided with a target electrode on a glass faceplate. A storage dielectric layer of phosphor material is disposed over the target electrode and a collector mesh electrode is provided in contact with the side of the phosphor layer facing the electron gun. The target electrode is used as an erase electrode for erasing stored information from the storage target and the collector electrode collects secondary electrons which are emitted from the charge image areas representing the stored information that has been written onto the storage target.

The foregoing target is also disclosed in U.S. Pat. No. 3,611,000 to Johnston regarding selective erasure of stored information on the storage target whereby the flood guns are turned off, the target electrode is raised to a predetermined level of positive voltage, the writing gun is activated to emit an electron beam and the electron beam is deflected in a raster configuration thereby erasing a selected portion of the stored image.

The Frankland target is expensive to manufacture, the thickness of the storage dielectric layer must be uniform in order to establish the correct voltage difference between the target and collector electrodes for proper operation of the target, difficult vacuum evaporations through a mask are required to make the target and the collector electrode must be destroyed to reclaim the faceplate and target electrode thereon.

SUMMARY OF THE PRESENT INVENTION

The present invention relates to storage targets and more particularly to bistable storage targets for use with a bistable storage tube which are capable of selective erasure of stored information on the storage target.

According to the present invention, a bistable storage target for use with a bistable storage tube comprises a faceplate having electrode means provided on an inside surface thereof. The electrode means includes first and second bus bars. Electrode members extend outwardly from the first and second bus bars toward respective bus bars; they are spaced from one another thereby forming an interdigitated electrode structure. The electrode members that extend outwardly from the first bus bar are provided with collector electrode members at spaced intervals therealong thereby defining collector electrode means. The electrode members that extend outwardly from the second bus bar define target electrode means which is isolated from the collector electrode means. A storage dielectric layer covers the electrode means and the collector electrode members extend through the dielectric layer with their outer surfaces being exposed.

An object of the present invention is to provide a bistable storage target having an interdigitated electrode means for extremely fast erase speed.

Another object of the present invention is the provision of a bistable storage target for use with a storage cathode ray tube that includes collector electrode means for collecting secondary electrons which are emitted from a charge image that is stored on the storage dielectric and target electrode means for selectively erasing stored information.

A further object of the present invention is to provide a bistable storage target wherein the electrode members carrying the collector electrode means and the electrode members defining the target electrode means define an interdigitated electrode structure which is disposed on the same surface of a supporting member.

An additional object of the present invention is the provision of a bistable storage target wherein the interdigitated electrode members have apertures therethrough for the purpose of viewing the information that is being displayed.

A still further object of the present invention is to provide a bistable storage target wherein the interdigitated electrode members are transparent to enable the information that will be displayed to be viewed.

Still an additional object of the present invention is to provide a bistable storage target of a bistable storage cathode ray tube that can provide electrical readout of information displayed on the target with an extremely fast erase speed which can be selectively applied, that has high resolution and very good bistable storage operation so that the tube can be operated as a scan converter for high-speed data transmission.

Still another object of the present invention is the provision of a bistable storage target wherein the interdigitated electrode members have collector electrode members, phosphor material of different color display is deposited in alternate layers over the respective electrode members with the collector electrode members extending through the phosphor layers so that different color displays of charge images can be shown.

BRIEF DESCRIPTION OF THE DRAWINGS

These and other objects of the present invention will be apparent from the following detailed description of preferred embodiments thereof and from the attached drawings of which:

FIG. 8 is a view taken along line 8—8 of FIG. 7;

FIG. 9 is a chart of waveforms illustrating a selective erase operation of the bistable storage target;

FIG. 10 is a cross section of a part of a further embodiment of the bistable storage target;

FIG. 11 is a plot of target secondary emission ratio versus potential on the bombarded side of the phosphor storage layer for the bistable storage tube of the present invention; and FIG. 12 is a plot of a waveform for an erase pulse employed in the apparatus of the present invention.

DETAILED DESCRIPTION OF THE INVENTION

Figure 1:
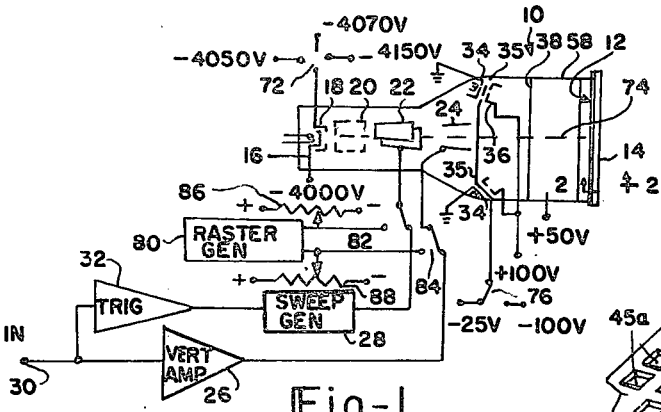
FIG. 1 is a schematic view of a storage apparatus utilizing a bistable cathode ray storage tube.
Figure 4:
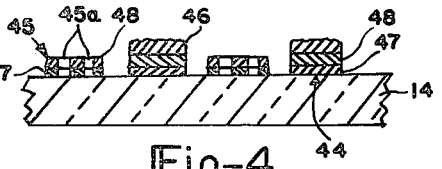
FIG. 4 is a cross sectional view taken along lines 4—4 of FIG. 3.
Figure 2:
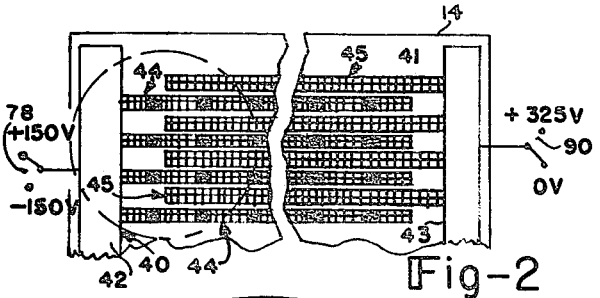
FIG. 2 is a top plan view of part of the interdigitated electrode structure on a faceplate.
Figure 5:
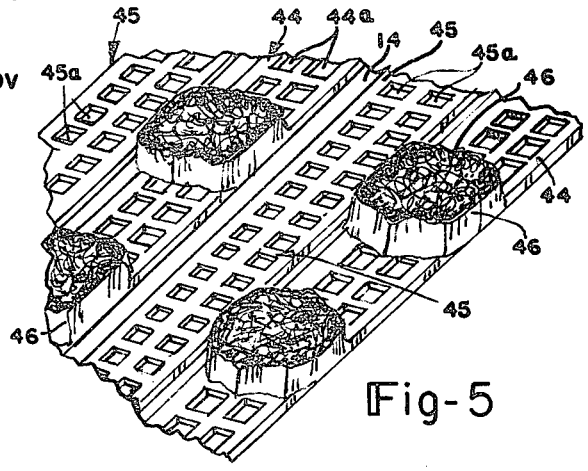
FIG. 5 is a perspective view of part of FIG. 2.
Figure 6:
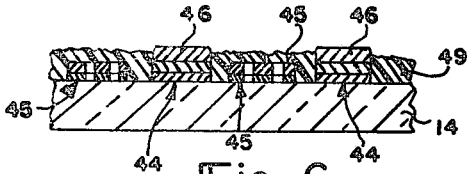
FIG. 6 is a view similar to FIG. 4 with a layer of bistable storage material on the faceplate and electrode structure.
Figure 3:
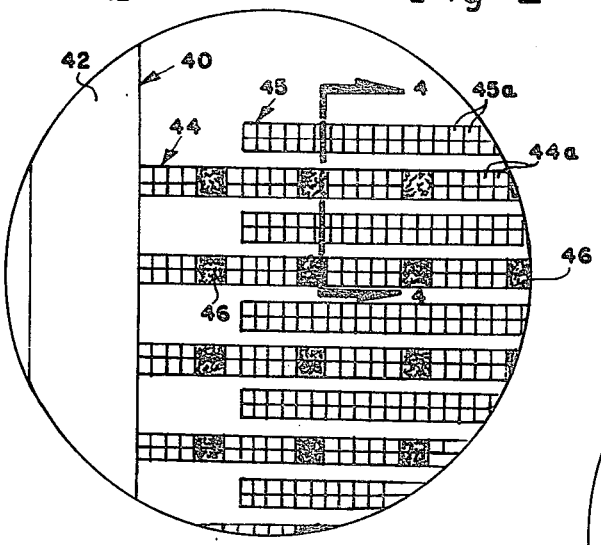
FIG. 3 is an enlarged section of FIG. 2.

As illustrated in FIG. 1, a storage tube 10 operated according to the present invention is of the direct viewing bistable type and includes a storage target 12 supported on a light transparent glass faceplate 14 forming part of the evacuated tube envelope hereinafter described in greater detail with respect to FIGS. 2–6. The storage tube includes a conventional writing gun, the cathode 16 of which may be connected to a negative DC supply voltage of about — 4,000 volts. The writing gun also includes a control grid 18, a focusing and accelerating anode structure 20, horizontal deflection plates 22, and vertical deflection plates 24. Control grid 18 is connected to switch 72 for selecting the proper grid bias. For normal writing of a stored image, the switch 72 is in the left-hand position, as shown, e.g. selecting a negative 4,050 volts. When the tube is used in a cathode-ray oscilloscope, the input signal is applied to the vertical deflection plates 24 through a vertical amplifier 26, while a ramp voltage sweep signal is applied to the horizontal deflection plates 22 by sweep generator 28. The sweep generator may be triggered in response to receipt of the vertical input signal at input terminal 30 by transmitting a portion of such input signal to trigger generator 32, the output of which is connected to the sweep generator.

In addition, in accordance with the present invention, a raster generator 80 is selectively connected to the horizontal deflection plates 22 and the vertical deflection plates 24 by means of operating switches 82 and 84 to their left-hand position from the normal position illustrated in FIG. 1. A positioning potentiometer 86, connected to a positive or negative voltage at its respective ends, has its movable tap connected to the raster generator output for the horizontal deflection plates, while a similar potentiometer 88 has its movable tap connected to the raster generator output applicable to the vertical deflection plates. Raster generator 80 suitably provides conventional television-type raster signals for the horizontal and vertical deflection plates, e.g. for causing deflection of electron beam 74 to produce a plurality of closely spaced horizontal traces. Potentiometers 86 and 88 are utilized for positioning the resulting raster upon target 12. The amplitude of the output of raster generator 80 is suitably controlled for enlarging or diminishing the size of the raster as desired. Raster tracing may be used for erasure as hereinafter described.

A charge image is written on the storage dielectric phosphor layer of the target 12 by the high-velocity electron beam 74 of the writing gun. A positive charge is written by high-energy electron beam 74, with secondary emission of electrons exceeding primary emission of the beam whereby an area of phosphor upon which the beam is directed is written positive. The potential of such area exceeds the first crossover voltage on the secondary electron emission characteristic curve of such phosphor layer, and the charge image may be stored bistably through uniform bombardment of the target with flood electrons. The flood electrons are emitted from a pair of flood guns having cathodes 34, control grids 35, and focusing anodes 36. The flood gun cathodes 34 are grounded while the focusing anodes are connected to a positive 100 volts. The grids 35 are coupled by way of switch 76 to either −25 volts or −100 volts. For normal writing of a stored image, the switch 76 is in the position shown for selecting the negative 25 volts. A plurality of suitable collimating electrodes may be provided to cause the flood electrons to strike the storage dielectric at right angles thereto. One such collimating electrode 38 is shown as a wall band coated on the inner surface of the tube envelope and connected to a source of positive DC supply voltage of approximately +50 volts.

FIGS. 2–6 illustrate direct-viewing bistable storage target 12 which includes a collector electrode structure 40 and a target electrode structure 41. Each electrode structure 40 and 41 is secured onto an inside surface of glass faceplate 14 and electrode structure 40 includes a bus bar 42 extending along one edge of faceplate 14 with electrode members 44 extending outwardly from bus bar 42 at spaced intervals therealong. The inside surface of faceplate 14 can be planar or curved and it is nonanomalous, i.e. smooth. Electrode members 44 extend along the inside surface of faceplate 14 and they terminate adjacent bus bar 43 of electrode structure 41 which also includes electrode members 45 extending outwardly from bus bar 43 at spaced intervals therealong as well as along the inside surface of faceplate 14; electrode members 45 terminate adjacent bus bar 42. Electrode members 44 and 45 extend between each other in spaced relationship thereby defining an interdigitated electrode structure. Eachelectrode member 44 has a collector electrode members 46 secured thereto at spaced intervals therealong. Thus, bus bar 42, electrode members 44 and collector electrode members 46 define collector electrode means and bus bar 43 and electrode members 45 define target electrode means.

The electrode structure is formed in accordance with conventional processing techniques or in accordance with the teaching in U.S. Pat. application Ser. No. 710,498, filed Aug. 2, 1976 wherein a layer of chromium 47 of about five hundred angstroms thickness is deposited onto the inside surface of faceplate 14. A layer 48 of gold having a thickness of 1500 angstroms is deposited over the chromium layer. The gold layer is covered with a photoresist which is masked, subjected to photographic exposure and developed thereby leaving openings that expose areas of electrode members 44. The exposed gold and chromium layers are respectively etched and the fixed photoresist is removed. A 2 mil thickness layer of photoresist is then applied onto the etched metal layers and the inside surface of faceplate 14. This photoresist is then exposed by a light source from the viewing side of faceplate 14 with the etched metal layers acting as a mask. The photoresist is developed leaving areas of the electrode members exposed which are plated with 2 mil thickness nickel whereafter the photoresist is removed. This leaves in position on faceplate 14 the interdigitated electrode structure with the electrode members 44 and 45 having openings **44*a* and 45*a*** extending through the gold and chromium layers in order to provide about a fifty percent transparency of information being displayed by the storage target.

After the interdigitated electrode structure is formed on faceplate 14, a layer of bistable phosphor material 49 is deposited onto the faceplate over the interdigitated electrode structure which is subjected to photographic processing steps so that collector electrode members 46 extend above the outer surface of the phosphor layer 49. The top surfaces of collector electrode members 46 can be located in the same plane as the outer surface of phosphor layer 49 or collector electrode members 46 can be omitted and openings can be provided in phosphor layer 49 exposing areas of electrode members 44 where collector electrode members 46 would be located. The collection efficiency of secondary electrons being emitted from charge images written on phosphor layer 49 would be greatest with collector electrode members 46 extending above the outer surface of phosphor layer 49, and it would be least with openings in phosphor layer 49 exposing areas of electrode members 44.

Phosphor layer 49 can be any suitable phosphor material such as manganese activated zinc orthosilicate which is conventionally identified as P1 phosphor. The phosphor can also be an admixture of P1 phosphor, yttrium oxide or yttrium oxysulfide or yttrium oxide or yttrium oxysulfide activated by a rare earth element such as disclosed in Ser. No. 658,977 filed Feb. 18, 1976.

Figure 7:
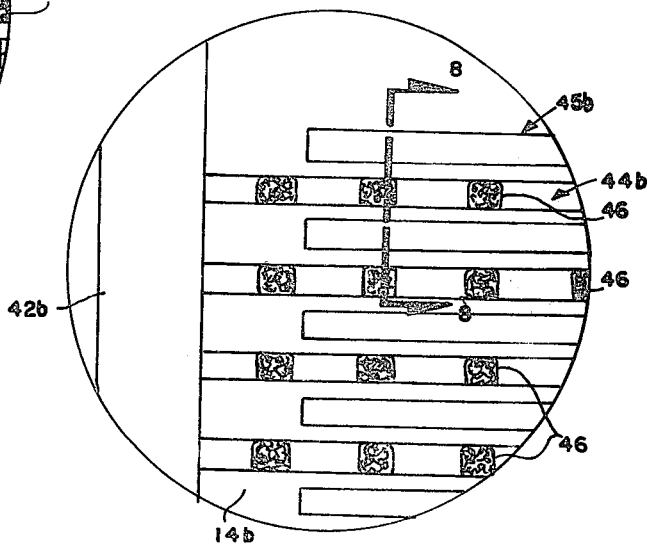
FIG. 7 is a view similar to FIG. 3 showing an alternative embodiment of the electrode structure.

FIGS. 7 and 8 illustrate an alternative interdigitated electrode structure which is identical in structure and manufactured in the same manner as that of FIGS. 2–6 except that the bus bars (only 42*b* being shown) and electrode members 44*b* and 45*b* are made from a layer of tin oxide having a thickness of about 1500 angstroms. Collector electrode members 46*b* of nickel are secured onto electrode members 44*b* at spaced intervals therealong by a layer of chromium 47*b* and a layer of gold or copper 48*b*. A phosphor dielectric (not shown) as hereinabove described is fabricated on the electrode structure and the faceplate 14*b*. The tin oxide electrode structure except where the collector electrode members are located provides a storage target that has seventy to eighty percent transparency when viewing the information that is displayed on the target.

FIG. 10 illustrates a further embodiment of the storage target which is identical to that of FIGS. 2–6 except that each electrode member 44*c* and 45*c* has collector electrode members 46*c* secured thereto at spaced intervals therealong. Each of electrode members 44*c* has a layer of phosphor material 50 of a selected color covering it except where collector electrode members 46*c* extend therethrough. Each of electrode members 45*c* has a layer of phosphor material 51 of another selected color covering it except where collector electrode members 46*c* extend therethrough. Phosphor material 50 can, for example, be yttrium oxide activated by europium to provide a red color and phosphor material 51 can be P1 to provide a green color. Thus, energization of electrode members 44*c* will display charge images having a red color and energization of electrode members 45*c* will display charge images having a green color so that green and red color information can be displayed simultaneously.

The storage tube envelope includes a funnel portion 58 of crystalline ceramic material such as Fosterite, which is sealed to the glass faceplate 14 by an intermediate seal portion of crystallized glass material or a glass different from that of the faceplate, as disclosed in U.S. Pat. No. 3,207,936 of W. H. Wilbanks, et al., issued Sept. 21, 1965. Bus bars 42 and 43 have sections that extend through the seal between the seal portion and the faceplate 14, out to the exterior of the tube envelope where they are respectively connected. The bus bar 43 is connected to a switch 90 for selecting between zero volts and +325 volts, the former being chosen for writing operation of the storage tube. Bus bar 42 has an operating voltage applied thereto from switch 78. Switch 78 selects either between the operating point of the phosphor and the voltage level in the opposite direction, with the former being chosen for normal storage writing operation. This voltage enables the collector electrode members 46 to collect secondary electrons emitted from the storage dieletric layer 49 due to bombardment by primary electrons emitted from either the writing gun cathode 16 or the flood gun cathodes 34, since such collector electrode is positive with respect to such cathodes.

Considering storage operation in greater detail, a written area is retained at a relatively positive potential, e.g. corresponding nearly to that of collector electrode members 46, after beam 74 has passed a given written area because of the action of the flood guns. The flood guns produce relatively low-velocity electrons which strike the target but which ordinarily have insufficient velocity for writing information. When the electrons from the flood guns strike areas of the target upon which a positive charge has not been written, these flood electrons tend to maintain such areas at the relatively negative potential of the flood guns, e.g. at ground level or zero volts. This is the lower stable potential level of the target. However, in other areas, a positive charge image may be written by electron beam 74 with secondary emission exceeding primary emission whereby a given area is written positive. The secondary electrons are collected by collector electrode members 46. The flood gun electrons are attracted to the positive written areas and obtain a high velocity with respect to these areas for producing continued secondary emission therefrom. Therefore, these areas are maintained relatively positive, near the potential of collector electrode members 46. This comprises the upper stable potential level of the target. The target thus has bistable properties and is capable of retaining information written thereon, with the flood beam of electrons driving target areas toward one of two stable potentials depending upon information written thereon with beam 74.

The manner in which storage operation takes place will be further described with reference to FIG. 11, a plot of secondary emission versus target potential for the side of the target and specifically the phosphor layer 49 which is bombarded by electron beam 74. Examining the curve of FIG. 11, two points can be seen at which the secondary emission ratio for the target is equal to one. At $V_d$, $\delta=1$ because the target, and specifically the beam side of the phosphor layer, has collected sufficient electrons to charge a few tenths of a volt negative with respect to the flood gun cathode, thereby rejecting all electrons. At $V_e$, the accelerating potential is high enough for the material on the phosphor surface to emit secondary electrons, and at $V_f$, the phosphor layer has charged a few volts higher than the collector electrode, and all secondary electrons in excess of primary electrons are returned to the target. $V_d$ and $V_f$ are the stable potentials. If the phosphor layer begins to rise above $V_d$, the layer collects electrons, the secondary emission being less than one, and the phosphor layer charges negatively, restoring the phosphor layer to $V_d$. If the target is bombarded with a high-energy electron beam 74, and the phosphor layer is allowed to charge by secondary emission to any potential just under $V_e$, it will return under the action of the flood guns to $V_d$. However, if it is allowed to charge more positive than $V_e$, due to the action of beam 74, the secondary emission caused by the flood electrons will discharge the phosphor layer positively until it reaches $V_f$. If it passes $V_f$, the secondary emission ratio becomes less than one, and any electrons arriving at the phosphor layer, they will attempt to charge the phosphor layer negatively. $V_e$ is described as the first crossover voltage of the secondary emission characteristic or the minimum voltage necessary for storage.

The voltage level at $V_e$ is also the writing threshold level, above which electron beam 74 must bring an elemental area of the phosphor layer in order for the flood beams to take over and retain such elemental area at a stable positive potential nearly equal to the potential of electrode members 46. This is the positive stable potential level of the target. All areas which have not been raised above this writing threshold by electron beam 74 will be retained by the flood beam electrons at a voltage close to the potential of the flood gun cathode, i.e. zero volts or the stable negative potential level for the target. Charging of the phosphor layer is understood to mean charging of the exposed surface thereof relative to target electrode means 45 with the phosphor layer forming the dielectric of a capacitor.

According to the present invention, an area of the target is selectively erased without changing the information stored on other areas of the target. This selective erasure is accomplished by altering the relative voltage differential of electrode members 44 and 45 for increasing the voltage difference between written areas, i.e. relatively positive areas of the target and the potential of the collector electrode means. The increased voltage difference between the written areas of the charge image and the potential of the collector electrode means is greater than the initial difference between written and unwritten areas of the phosphor layer. This voltage difference is arranged so that the written areas are momentarily relatively positive as compared to the potential of collector electrode members 46. Also, the flood beams from the flood guns are momentarily discontinued, while an area to be selectively erased is bombarded with electrons from the writing gun, i.e. by the electron beam 74. With electron bombardment, written areas are charged down toward the potential of the collector electrode means. Bombarded areas are ordinarily driven toward collector potential, and writing gun electrons are collected at the surface of the phosphor layer even though the secondary emission ratio is greater than one. The normal voltage differential difference between target and the collector electrode members is then restored, together with restoration of operation of the flood guns, such that normal writing operation can be continued. The period during which the phosphor layer is bombarded with high-velocity electrons from the writing gun is long enough to lower such selected area to a voltage level which will be below the first crossover voltage of the secondary emission characteristic of the phosphor layer after the normal voltage differential is restored. Therefore, flood electrons now impinging upon the "erased" portion of the phosphor layer will drive it toward the "nonwritten" stable potential of the target, and these areas will be retained in the nonwritten state due to the normal action of the flood beams.

Referring to a specific method of selective erasure according to the present invention, the waveform chart of FIG. 9 will be considered. It is assumed that certain areas of the phosphor layer 49 have been written to provide a relatively positive charge image near the potential of the collector electrode members 46, while nonwritten areas reside at the potential of the flood gun cathodes, i.e. zero volts. It will be assumed also that the writing gun is now off, with the switch 72 connecting grid 18 to a −4150 volts. Otherwise, at this time, the position of various switches in FIGS. 1 and 2 will be as shown. In order to produce erasure of a specific area, the flood guns are first shut off as indicated in FIG. 9. This can be accomplished by operating switch 76 so that −100 volts is provided at flood gun grids 35 instead of −25 volts. The target electrode voltage is now switched from zero volts to +325 volts through operation of switch 90 to its upper position. Both written areas and background areas on the exposed surface of phosphor layer 59 will rise by 325 volts as a consequence of capacitive coupling from target electrode members 45. This change in target electrode voltage for erasure is greater than the normal voltage difference (about 150 volts) between written and unwritten areas of the phosphor layer. Also, the target electrode means is raised in this instance to a potential higher than that of the collector electrode members 46. Switch 72 is now moved to its left-hand position applying a −4,050 volts to the writing gun, and the writing gun is deflected to a location where erasure is desired. Both the written and background non-written areas of the phosphor layer charge downward toward the 150 volt collector voltage.

The time required to bring about erasure is the time necessary for charging the selected area of the target to be erased down to a voltage level which is reducible below the first crossover of the secondary emission characteristic of the phosphor layer, by restoration of normal potential conditions. Thus, after a predetermined period of time, the writing gun is deactivated by returning switch 72 to its right-hand position, whereby the area to be erased receives no more negative charge. Now, the target electrode voltage is returned to zero volts by returning switch 90 to its lower position. Through capacitive coupling, written and background areas of the phosphor layer are lowered by 325 volts to 60 volts and −30 volts respectively. In the case of a particular constructed embodiment, +60 volts is below the first crossover voltage of the secondary emission characteristic for the phosphor layer. Now the flood guns are once again turned on, and the low-velocity electrons therefrom charge former written areas negatively toward zero volts and background areas positively toward zero volts, completing erasure of a particular selected target area. The specific time for erasure of the selected area of the target depends upon the current in the beam, because the total charge delivered per unit area is a determining factor for erasure. In a typical example, the time required for erasing the selected area corresponding to the trace of the stationary electron beam was about 100 milliseconds.

For the purpose of selectively erasing written information within a larger selected area of the storage target, a raster generator 80 is employed for causing scanning of electron beam 74 in a systematic manner over a desired area of the stored image. Switches 82 and 84 are in their left-hand position so that the raster outputs are applied to the horizontal and vertical deflection plates of the tube. The raster generator is suitably controlled to adjust the amplitude of the outputs thereof so that a raster having a size corresponding to the size of the erased area is generated. The movable taps on potentiometers 86 and 88 are employed for positioning of such raster upon the phosphor layer. Thus, the raster is generally small compared with the overall size of phosphor layer 40, and it may be positioned to a particular portion of the image which it is desired to erase.

The tube illustrated and described hereinabove is suitable of the direct view type whereby the stored information is observed through glass faceplate 14. When a particular area is to be erased, switch 72 is first thrown to the middle position, e.g. selecting a −4,070 volts, and the raster generator is energized with switches 82 and 84 connecting the raster generator to the deflection plates. The bias for writing gun grid 18 selected by switch 72 in its middle position provides an electron beam 74 which has insufficient average current density for writing of stored information upon the phosphor layer 49. That is, with switch 72 connected as described, electron beam 74 will not raise a portion of the target above the first crossover voltage of the secondary emission characteristic of the phosphor layer, during raster scanning. However, the raster so generated may be viewed through faceplate 14 for positioning such raster upon the phosphor layer. Thus, potentiometers 86 and 88 may be adjusted for moving the raster in the X and Y directions, respectively, while controls of the raster generator may be employed to magnify or demagnify the size of the raster itself by varying the output amplitudes. Then, after such raster is positioned over an area of trace information which it is desired to erase, the hereinbefore described erasing procedure is suitably followed.

The raster generator 80 suitably generates deflection signals for producing a series of closely spaced horizontal traces across phosphor layer 44 in a horizontal direction. That is, a first sawtooth voltage is applied between vertical deflection plates 24, and a faster sawtooth voltage is applied between horizontal deflection plates 22 for generating a raster in the usual manner as understood by those skilled in the art. However, the speed of the deflection in the case of erasure should not be so rapid, nor the size of the raster used for erasing so large, that insufficient charge is deposited in the erase cycle to produce the erasing effect.

It will also be understood that the switching as accomplished by switching devices 72, 76, 82, 84, and 90 is more suitably accomplished with electronic switching apparatus than with actual manually operated switches. Although a raster trace is suitably employed for erasure, the speed of erasure is quite rapid since erasure is limited only by the amount of beam current available during erase time. The period for total erasure is sufficiently short so that the stored image is not lost during the erasure period although flood electrons are temporarily absent.

As hereinbefore mentioned, the change in target electrode voltage for erasure is greater than the voltage difference between written and unwritten portions of the phosphor layer or the normal voltage difference between the collector electrode members 46 and the flood gun cathodes. Thus, the target electrode pulse for erasure in the present example was 325 volts in amplitude, while the difference between the flood gun cathode voltage and the collector voltage was 150 volts. In general, the change in the target electrode voltage should be at least approximately twice the difference in voltage between written and unwritten areas on the phosphor layer. Thus, since the target electrode voltage is initially zero volts, the target electrode is raised from a voltage level below that of the collector electrode to a voltage level considerably above that of the collector electrode. This voltage pulse is capacitively coupled to the electron beam side of the phosphor layer, and establishes the voltage levels at which both written and unwritten areas start to charge down toward the collector electrode voltage. Therefore, if the target electrode voltage is high, the written and unwritten areas of the phosphor storage layer will charge down more rapidly. Thus, employing the higher voltage pulses speeds the erase operation.

Moreover, the high-voltage target electrode pulse, of at least twice the written and nonwritten differential, enhances the resolution of erasure and maintains trace edge integrity. When the writing gun is employed for erasure as hereinbefore described, secondary electrons are produced which themselves tend to land on other portions of the phosphor layer near the area which is being erased. With the higher target electrode pulse, this effect is minimized, since the primary beam and secondary electrons are confined by the higher voltage. It is noted the same problem of beam integrity does not occur during writing since the secondary electrons themselves do not have sufficient energy for writing and are ineffective for erasure in the presence of the flood beam. However, when the writing beam is used for erasure, the secondary electrons themselves may produce erasure, unless the beam is confined by a high-voltage pulse.

It if is desired to completely erase information in the form of charge images from storage target 12, an erase pulse as shown in FIG. 12 is applied from a conventional erase pulse generator (not shown) as disclosed in U.S. Pat. No. 3,421,041 to the collector electrodes means which causes the target to fade positive or assume a completely written condition between $t_1$ and $t_2$. At $t_2$ the voltage at the collector electrode means changes substantially instantaneously and then rises along an RC time constant curve to $t_3$. The negative portion of the erase pulse is long enough and of sufficient potential to bring the target dielectric 49 back across the threshold level in a negative direction. The erase pulse which comprises a positive signal followed by a negative signal is preferred because a uniform erasure occurs and the entire target ends up at substantially the same potential.

The information displayed on storage target of FIG. 10 is erased by applying an erase pulse of FIG. 12 to electrode members **44*c* and 45*c*** which will completely erase the stored information from the target.

Information that is stored on storage target 12 can be read out therefrom in a conventional manner as disclosed in U.S. Pat. No. 3,594,607 by use of a read out circuit connected to the collector electrode means which comprises a voltage divider network that is connected in series with a capacitor which in turn is connected to amplifying means. The raster generator 80 is used to scan electron beam 74 across the target surface of dielectric layer 49 at a current level that will not destroy the stored information.

It will be obvious to those having ordinary skill in the art that many changes may be made in the above-described embodiments of the present invention without departing from the spirit and scope of the present invention. Therefore, the scope of the present invention should be determined by the following claims.

The invention is claimed in accordance with the following:

1. A cathode ray storage tube apparatus for storing written information, comprising:

an evacuated envelope;

a storage target secured onto said evacuated envelope including an insulative support member having first electrode means including spaced first electrode members extending along an inside surface of said support member and second electrode means including spaced second electrode members extending along said inside surface in interdigitated relationship with respect to said spaced first electrode members of said first electrode means, a layer of storage dielectric material provided onto said support member over said inside surface and said interdigitated electrode members, collector electrode means provided by said first electrode members of said first electrode means;

writing means mounted within said envelope for bombarding said storage level with a writing beam of high velocity electrons including means for deflecting said writing beam across said storage target to produce an electron image in accordance with input information on said storage dielectric layer corresponding to the input information;

holding means mounted within said envelope for bombarding said storage target substantially uniformly with low velocity electrons which cause secondary electrons to be emitted from said electron image and said secondary electrons being collected by said collector electrode means thereby causing said electron image to be stored bistably for an indefinite controllable time on said storage dielectric layer; and selective erasing means connected to said holding means, said second electrode means, said writing means and said deflecting means for turning off said holding means during a period that selective erasing of stored information takes place, for raising said second electrode means to a predetermined potential, for activating said writing means to bombard said storage target with an erasing beam of electrons and for controlling said deflecting means to deflect said erasing beam of electrons to a selected area of said storage target thereby erasing the portion of said electron image that is stored in said selected area.

2. A cathode ray storage tube apparatus according to claim 1 wherein said collector electrode means define collector electrode members extending through said storage dielectric layer and they have portions which extend above the top surface of said storage dielectric layer.

3. A cathode ray storage tube apparatus according to claim 1 wherein said insulative support member is transparent.

4. A cathode ray storage tube apparatus according to claim 1 wherein said electrode members have openings therethrough.

5. A cathode ray storage tube apparatus according to claim 1 wherein said electrode members are transparent.

6. A cathode ray storage tube apparatus according to claim 1 wherein said second electrode means is raised above said collector electrode means.

7. A cathode ray storage tube apparatus according to claim 1 wherein erasing means is connected to said first electrode means for applying erasing pulse means thereto to completely erase stored information from said storage target.

8. A storage target for use with a storage cathode ray tube having writing means for generating a high velocity electron beam including deflecting means for deflecting the high velocity electron beam across and along said storage target and holding means for generating low velocity electrons and directing them onto the storage target, said storage target comprising:

an insulative support member having an inner smooth and substantially nonanomolous surface;

first electrode means provided on said inner surface of said insulative support member including spaced first electrode members;

second electrode means provided on said inner surface of said insulative support member including spaced second electrode members, said first electrode members and said second electrode members being disposed adjacent each other in spaced relationship thereby defining an interdigitated electrode structure;

collector electrode means provided by said first electrode members at spaced intervals therealong; and a layer of bistable storage material provided on said inner surface of said support member and over said interdigitated electrode structure, said storage layer having openings therethrough for said collector electrode means.

9. A storage target according to claim 8 wherein said insulative support member is transparent.

10. A storage target according to claim 8 wherein said layer of bistable material is a phosphor material.

11. A storage target according to claim 8 wherein said collector electrode means comprise collector electrode members the outer ends of which extend outwardly beyond the top surface of said bistable storage layer.

12. A storage target according to claim 8 wherein said electrode members have openings therethrough.

13. A storage target according to claim 8 wherein said electrode members are transparent, except where said collector electrode means are located.

14. A storage target according to claim 8 wherein said second electrode members are provided with collector electrode means at spaced intervals therealong.

15. A storage target according to claim 14 wherein said layer of bistable storage material comprises first and second sections of phosphor material, said first section of phosphor material display one color and they overlie said first electrode members and said inner surface of said insulative support member with said collector electrode means extending therethrough exposing outer ends thereof, said second sections of phosphor material display another color and they overlie said second electrode members and said inner surface of said insulative support member with said collector electrode means extending therethrough and exposing outer ends thereof.

* * * * *

UNITED STATES PATENT AND TRADEMARK OFFICE

CERTIFICATE OF CORRECTION

PATENT NO. : 4,139,800

DATED : February 13, 1979

INVENTOR(S) : Bruce H. Ostermeier; Duane A. Haven; Gordon M. Sletmoe

It is certified that error appears in the above-identified patent and that said Letters Patent are hereby corrected as shown below:

Column 4, Line 21, "Eachelectrode" should be --Each electrode--.

Column 10, Line 19, "It if is" should be --If it is--.

Signed and Sealed this

*Fourth* Day of *September 1979*

[SEAL]

*Attest:*

*Attesting Officer*

LUTRELLE F. PARKER

*Acting Commissioner of Patents and Trademarks*